United States Patent [19]

Tillotson

[11] 3,993,313

[45] Nov. 23, 1976

[54] JIG-SAW PUZZLE EDUCATIONAL GAME DEVICE

[76] Inventor: Richard Tillotson, EWC 1199, The East-West Center, 1777 East-West Road, Honolulu, Hawaii 96822

[22] Filed: Sept. 26, 1974

[21] Appl. No.: 509,415

[52] U.S. Cl. ..... 273/130 AC; 273/130 R; 46/25; 273/130 A; 273/157 R

[51] Int. Cl.[2] ..... A63F 3/00

[58] Field of Search..... 273/1 M, 130 R, 130 AC, 273/137 AE, 137 R, 137 C, 157 R, 160; 46/23, 25, 45; 35/69–72, 31 F, 31 G, 31 D, 31 R

[56] References Cited

UNITED STATES PATENTS

| | | | |
|---|---|---|---|
| 2,201,724 | 5/1940 | Gable | 273/160 |
| 2,513,596 | 7/1950 | Severson et al. | 35/70 |
| 2,981,009 | 4/1961 | Lindquist | 35/69 X |
| 3,082,004 | 3/1963 | Friedman | 273/1 M X |
| 3,094,792 | 6/1963 | Morgan et al. | 35/31 R |
| 3,214,171 | 10/1965 | Luchsinger | 273/1 M X |
| 3,248,804 | 5/1966 | Jorgens | 35/31 D |
| 3,302,311 | 2/1967 | Israel | 273/157 R UX |
| 3,696,533 | 10/1972 | Mortensen | 35/70 |
| 3,764,144 | 10/1973 | Arthur | 273/1 M X |

*Primary Examiner*—Richard C. Pinkham
*Assistant Examiner*—William R. Browne
*Attorney, Agent, or Firm*—James C. Wray

[57] ABSTRACT

Six-sided cubic blocks with interfitting and repelling sides have selected representations on each side according to predetermined patterns of relationships between side structures and representations. The blocks are assembled in horizontal and vertical arrays to achieve numerical goals of representations on faces of the arrays. Two persons work on the vertical array from opposite sides seeking to attain their own goals, while preventing opposite persons from attaining their goals.

7 Claims, 2 Drawing Figures

JIG-SAW PUZZLE EDUCATIONAL GAME DEVICE

BACKGROUND OF THE INVENTION

Before an application was prepared, a preliminary search was conducted in the United States Patent Office. The search covered United States patents officially classified and cross-referenced in, and publications and foreign patents collected by the examiners in: Class 273 Games, subclasses 130, 131, 135, 136, 137, 156 and 157; Class 35 Teaching, subclass 27; and in Class 46 Amusement Devices, subclasses 16, 25 and 28. The fields of search were discussed with Patent Office Examiner Lowe. Examples of the most pertinent U.S. Pat. Nos. which were found are: 3,302,310, 3,403,460, 3,672,681, 3,674,274, 3,788,645, 2,819,904, 2,570,625.

U.S. Pat. No. 3,302,310 describes sides with interfitting features.

U.S. Pat. No. 3,403,460 shows four variable sides of blocks. FIG. 14.

U.S. Pat. No. 3,672,681 shows all sides of blocks are identical.

U.S. Pat. No. 3,674,274 has colored sides with colored dots on sides.

U.S. Pat. No. 3,788,645 describes a colored cube puzzle, but no interfitting or repellent feature is disclosed.

U.S. Pat. Nos. 2,819,904 and 2,570,625 were selected for their showings of magnets in blocks.

SUMMARY OF THE INVENTION

Six-sided cubes have self-repellent or interfitting sides and symbols, colors, and pictures on sides. The self-repellent features are in different relationships on different groups of blocks. The symbols are varied on blocks. Three unique symbols appear on various block faces. The self-repellent features are concave and convex sides or polarized magnets arranged in predetermined directions.

A board with openings receives the pieces. In one preferred embodiment 25 pieces are provided. Pieces are permanently placed in square arrangements having no more than five pieces on a side. One person uses a horizontal array; two persons use a vertical array. Goals reckon particular numbers and arrangements of particular colors or symbols.

The present invention is a challenging educational device that has been characterized as a kind of three-dimensional jig-saw puzzle. In one form, based on the principles of population and ecology, the invention demonstrates the possibility of apparent infinite variety within a closed system. Within certain parameters, the invention allows one to define his own goals and to achieve them, if he is willing to make compromises. The invention can be used as an educational and entertaining solitary form, or it can be used competitively between two persons. The final arrangement of the whole board, not a particular piece at a particular time, must engage one's attention. The invention presents simple problems and at the same time very challenging and complex ones. The problems can be solved and the apparatus may be used by both children and adults.

The apparatus in one embodiment is composed of twenty-five blocks that are fitted flush with one another to form a square array, five blocks to each side. This square is arranged either horizontally on the playing tray or stands vertically up from it. The sides of the blocks are either concave or convex, and each side has a representation which may be a picture. The total number of representations for example pictures, are as follows:

| | |
|---|---|
| Pictures of people (blue) | 28 |
| Pictures of industry (yellow) | 28 |
| Pictures of nature (green) | 94 |
| | 150 |

A solitary embodiment of the invention is used by development horizontally on the tray. The object is to assemble all the blocks into the five-by-five square so that they all fit flush with one another. Any arrangement that allows one to accomplish this is successful, but the convex/concave surfaces make this more difficult than it seems. After one has succeeded in assembling the square several times, the arrangements and proportions of the three different kinds of pictures that appear on the horizontal surface of the square are noted. A total of 25 of these pictures (people/industry/nature) appears on the horizontal surface of the assembled square, which is representative of a world. Since there are a total of 56 pictures of people and industry within the apparatus, one should be able to eliminate nature entirely from the surface of the world. That is one goal. How few people one can have is another goal. To eliminate industry from the surface of your world is another goal. One may decide to place a particular factory next to a particular person and a particular park, but the arrangement at the particular time will not allow it. One starts over and rearranges the apparatus to make that particular combination, noting what other rearrangements and compromises he has to make.

In an embodiment which takes advantage of a contest between two opponents, the apparatus is arrayed vertically on the tray. Each person selects 12 blocks at random. The person with the first move places the 13th block on one of the hollows along the center of the playing tray. He must make this opening move before he examines the other 12 blocks he has selected. Each person in turn then places one block on the tray so as to construct the world square in a vertical array. A person cannot pass; if it is possible for him to place a block, then he must do so. Blocks cannot be rearranged once they have been placed, nor can a person build taller than five blocks high. Any placement is appropriate so long as it is within the five-by-five block square pattern.

It will be seen that as the world square is assembled, there are two different arrangements of pictures on either side of the square. These two arrangements are not mirror images of each other, but will always be different. As each person places a block with his own arrangement of pictures in mind, he necessarily affects the arrangement of pictures for the opposite person. During the interaction, each person should not be allowed to see either the opposite arrangement or the opponent's selection of blocks.

The object is for a person to accumulate a total number of one of the three different kinds of pictures on his side of the world square, for example:

Nature. . .15, People. . .10, and Industry. . .10

Whichever person first reaches one of these three totals attains his object. If neither person reaches one of these totals, the operation is a draw. When operating competitively, it is much more difficult to complete the world square using all 25 blocks. When this does happen, the operation again is a draw, but both persons can consider themselves to have achieved the objective.

In another embodiment of use of the apparatus each person tries to reach or to exceed totals for each kind of picture:

Nature. . .30, People. . .15, and Industry. . .15

In this embodiment several rounds are taken at constructing the world square to achieve one's goal. When neither person can place a block, that round is over, and they must begin again. After each round, the total numbers of each of the pictures for each person is noted on a card. During each round, however, neither person should be allowed to see the other's arrangement. If on any one round the persons should succeed in completing the world square using all 25 blocks, they are then each awarded 5 points that they can distribute on their card however they wish.

For children the apparatus is used as simply as a set of blocks. No instructions are necessary, because the principles are built into the structure. When using the blocks, the point is inevitably made that a balance of people, industry, and nature is required for the world to fit together.

In one embodiment of the invention the apparatus comprises 25 cubes or blocks that are fitted flush with one another to form a square array, five blocks to each side. This square is arranged either horizontally on a playing tray or stands vertically up from it.

Each block is generally described as having each of its sides either concave or convex and as having pictures drawn on each of its sides as well.

The pictures are divided into three generic types and are color coded as follows: pictures of people — blue, pictures of industry — yellow, and pictures of nature — green. Four sets of blocks comprise the total number of 25 blocks. The blocks in each set have a specific arrangement of convex-concave sides in combination with the color coding for each side.

While the side representations and structures may be varied, the following describes a preferred embodiment.

Six-sided cubic blocks are used.

A set $A_1$, with a total of 11 blocks, is comprised of blocks of the following description. Sides 1 and 2 are concave. Sides 3, 4, 5 and 6 are convex. Side 1 is blue; side 2 is yellow; and sides 3, 4, 5 and 6 are green.

In set $A_2$, a total of three blocks is comprised of the following description. Sides 1 and 2 are concave. Sides 3, 4, 5 and 6 are convex. Side 1 is blue; sides 2 and 3 are yellow; and sides 4, 5 and 6 are green.

Set $A_3$ has a total of three blocks. Each block has the following description. Sides 1 and 2 are concave. Sides 3, 4, 5 and 6 are convex. Sides 1 and 4 are blue, and side 2 is yellow. Sides 3, 5 and 6 are green.

Set B has eight blocks. Each block has this description. Sides 3 and 6 are concave. Sides 1, 2, 4 and 5 are convex. Side 1 is blue; side 2 is yellow, and sides 3, 4, 5 and 6 are green.

Totals are as follows:

Total number of sides . . . 150

Total number of convex sides . . . 100

Total number of concave sides . . . 50

Total number of pictures of people (blue) . . . 28

Total number of pictures of industry (yellow) . . . 28

Total number of pictures of nature (green) . . . 94

When the 25 blocks are fitted flush to one another in a square five blocks by five blocks, there are 25 pictures visible on one horizontal surface. Since the total number of each kind of picture exceeds 25, it would seem easy to assemble the square so that only one kind of picture would be visible on the horizontal surface. However, because of the convex/concave sides on the blocks, that is difficult. Beyond certain parameters, it appears impossible to assemble the square so that all 25 blocks can be fitted flush with one another in the five block by five block square. These parameters appear as follows:

Maximum possible number of blue pictures (People) . . . 16

Maximum possible number of yellow pitures (Industry) . . . 16

Maximum possible number of blue and yellow combined . . . 19

Maximum possible number of green pictures (Nature) . . . 25

Minimum possible number of blue pictures . . . 0.

Minimum possible number of yellow pictures . . . 0

Minimum possible number of blue and yellow combined . . . 0

Minimum possible number of green pictures . . . 6

For one goal the square is assembled so that all 25 pictures on the horizontal surface are nature. While the limits of representations on a face of the square are unnecessary to an understanding of the invention, it is apparent that an upper limit of blue and yellow pictures, people and industry, is 19. The parameters extend to a minimum of zero for people and industry pictures, and a maximum of 25 for nature pictures.

In one form of the invention, the blocks in the model are 2 inches to a side. The convexities and concavities are ¼ inch deep. The convex surfaces are 1¼ inches in diameter, and the concave surfaces are 1½ inches in diameter. It is necessary for the concave surfaces to be wider than the convex ones so that a block can be fitted into an inside corner when desired. The convex/concave surfaces are as close to the edges of the sides of the block as possible. Plastic injection moulding produces blocks. In another form hollow blocks are produced by stamping out the convex/concave sides and then assembling them into blocks.

For the purposes of one model, pictures are not necessary. Pictures used in other models are selected carefully. In one example, 150 actual photographs of people/industry/nature from around the world are chosen. Each one is different. The use of just color-codings and no pictures is satisfactory. In another embodiment nine simple line-drawings are used. Three different ones are used for each kind of picture. These drawings are distributed in even proportions throughout the four sets of blocks. In this way, no block is immediately recognizable as belonging to a particular set simply by looking at one of the drawings. This preserves the uncertainty about an opponent's arrangement when operating competitively. At the same time, it should provide considerable variety for the assembled surface of the world square.

In the color coded embodiment, green is a logical choice for nature, and yellow is appropriate for industry. Blue is chosen for people so that the color is not tagged to any particular race or ethnic group.

In one embodiment of the invention the apparatus uses bar magnets instead of concave/convex surfaces. Each side which is now convex had a bar magnet running perpendicularly to the center of its surface from the center of the block. All magnets had the same pole pointing outward. The sides which are now concave were neutral — no magnets. Using that design, a block placed incorrectly springs away from the others out of its own accord. The cost of the magnets and their tendency to reverse polarity makes that embodiment less useful.

While the specific materials or structures are important, the arrangement and relationship of the elements are chief features. Important features of the invention are the six-sided cube, the self-repellent surfaces and the symbols which may be people/industry/nature. It is possible to use more or less than the number of 25 blocks found in the described embodiment. To increase or decrease the numbers of blocks in each set ($A_1$, $A_2$, $A_3$, $B_1$,) or to rearrange the symbols on each side of a block so as to produce a new set changes the parameters of operation. The basic idea remains the same; balances and compromises are required for the blocks to fit together.

In the solitaire embodiment of play a player may choose to rearrange blocks after they have been positioned. In the vertical two opponent embodiment blocks remain in position once positioned.

Faces of blocks are abutted to interfit opposite facial types or to juxtapose facial types which are not mutually repulsive. For example, in a magnetic embodiment faces without magnets may be juxtaposed. In the convex embodiment, concave faces may be juxtaposed.

One object of the invention is the provision of plural cubic blocks having six side faces and engagement means mounted on the block at the faces, the engagement means comprising first attachment means and second attachment means selectively positioned on different faces of the blocks, the first attachment means and second attachment means being mutually conjunctive when juxtaposed on faces of adjacent blocks and the first attachment means being repulsive to first attachment means and the second attachment means being repulsive to second attachment means when juxtaposed on faces of adjacent blocks, and a plurality of representation symbols on each block, the representation symbols and the attachment means being organized in a predetermined arrangement.

Another object of the invention is the provision of blocks as described wherein the first attachment means comprises a convex spheroidal lug positioned in a center of a face, and wherein the second attachment means comprises a complementary concave spheroidal depression in a center of a face.

The invention has as another object the provision of blocks as described wherein the blocks are arranged in square arrays having interengaging first and second attachment means on juxtaposed faces and wherein the blocks are organized with equal numbers of blocks in sides of the array and wherein blocks are positioned in the array according to predetermined numerical limitations of the representation symbols, and wherein the blocks are arranged in horizontal arrays with singe faces of the blocks revealing representation symbols in the array and are arranged subsequently in vertical array with representation symbols exposed on opposite sides of the array.

Another object of the invention is the provision of a method of juxtaposing cubic blocks having facial representation symbols and having first and second complementary attachment means, and arranging the blocks in predetermined arrays with predetermined quantities of representation symbols on one face of an array so that the blocks closely fit together and do not repel each other.

Further objects of the invention are arranging the cubic blocks in a horizontal array with a single upward face, and arraying the cubic blocks in vertical array having opposite faces exposed, while arranging the blocks so that predetermined numbers of unique surface representation symbols are apparent on the opposite faces of the array.

A further object of the invention is the sequentially and alternately placing of blocks as described in a vertical array by persons positioned on opposite sides of the array so that only one face of the array is visible to one person.

Another object of the invention is to provide blocks as described arranged in an array with interfitting first repulsive second nonrepulsive attachment means and abutting second attachment means.

DETAILED DESCRIPTION OF THE DRAWINGS

Figure 1:
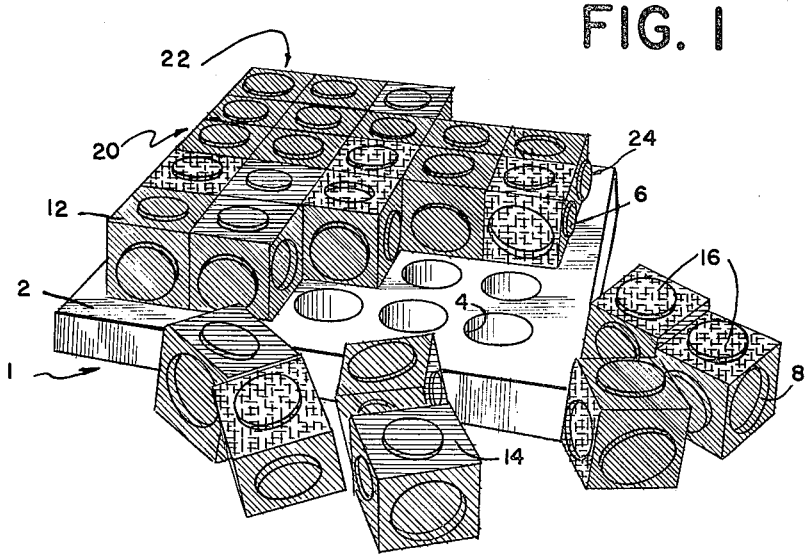
FIG. 1 is a perspective view of the apparatus of the invention showing a horizontal array embodiment.

Referring to FIG. 1, a comprehensive enrichment apparatus comprises a plurality of cubic blocks 1 arranged on a baseboard 2. The board has a plurality of depressions 4 arranged rectilinearly in a square pattern on board 2.

Each block has six faces. Each face has a convex spheroidal attachment means 6 or a concave spheroidal attachment means 8. The convex and concave means are arranged according to a predetermined relationship.

Each face has a selected surface representation from a plurality of representations, in this case three different representations. In the present case, the different representations are distinguished by color differential. 12 represents green coloring; 14 represents blue coloring and 16 represents yellow.

In the horizontal array 20 shown in FIG. 1, the blocks 1 are arranged so that an upper face of the array 20 will have a predetermined number of blocks of certain colors. The holes 4 in the base require that the blocks be juxtaposed. The convex and concave attachment means in 6 and 8 in the blocks require that the blocks be arranged only in certain interfitting relationships. As described in the summary, the goals of particular numbers of surface representations on the upper face of the horizontal array are difficult to achieve. The blocks are aligned in the array according to columns 22 and rows 24. Each column and row has a limited number of blocks. The array 20 shown in FIG. 1 is completed with five blocks on each side of the square array.

Figure 2:
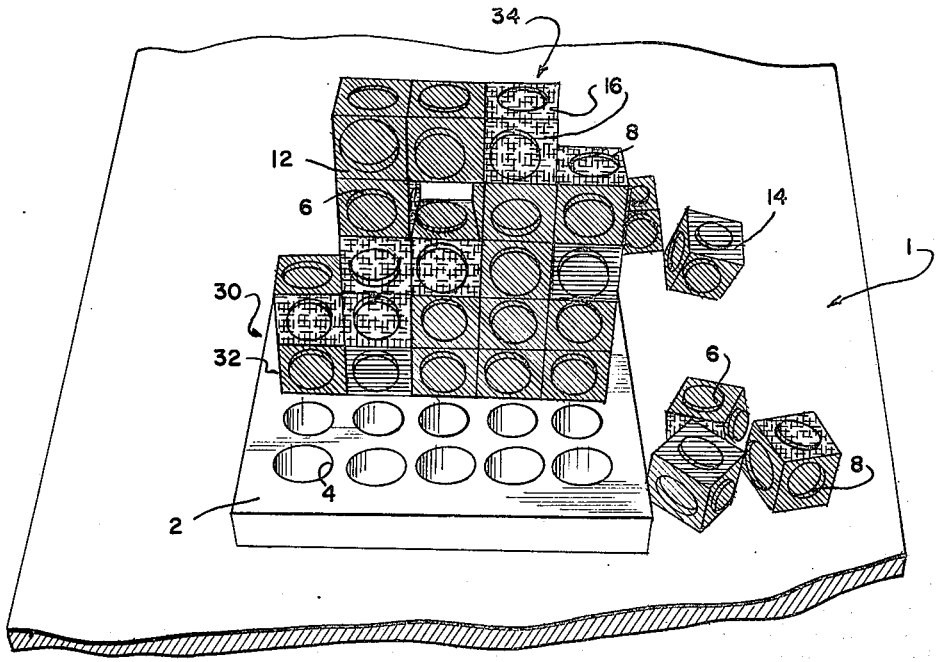
FIG. 2 is a perspective view of a vertical array embodiment of the invention.

As shown in FIG. 2, a vertical array 30 has rows 32 and columns 34. Opposite faces of the array are exposed.

While the invention has been described with reference to specific embodiments, it will be obvious to those skilled in the art that modifications and variations of the invention may be constructed without departing from the spirit and scope of the invention. The scope of the invention is defined in the following claims.

I claim:

1. Comprehension enhancing apparatus comprising plural cubic blocks having six side faces and engagement means mounted on the blocks on all faces, the engagement means comprising first attachment means and second attachment means selectively positioned on different faces of the blocks, the first attachment means and second attachment means being mutually conjunctive when juxtaposed on faces of adjacent blocks and the first attachment means being repulsive to first attachment means and the second attachment means being neither conjunctive nor repulsive to second attachment means when juxtaposed on faces of adjacent blocks, and a plurality of representation symbols on each block, the representation symbols and the attachment means being organized in a predetermined arrangement, and a base having attachment means for individually holding the first attachment means while not repelling the second attachment means, whereby rows of blocks with interengaged first and second attachment means are arranged on the base with the base attachment means holding the rows by engaging with the first attachment means on individual blocks.

2. The comprehension enrichment apparatus of claim 1 wherein the first attachment means comprises a convex spheroidal lug positioned in a center of a face, and wherein the second attachment means comprises a complementary concave spheroidal depression in a center of a face, and wherein the base attachment means comprise uniform concave circular depressions.

3. The comprehension enrichment apparatus of claim 1 wherein the blocks are arranged in square arrays having interengaging first and second attachment means on juxtaposed faces and wherein the blocks are organized with equal numbers of blocks in sides of the array and wherein blocks are positioned in the array according to predetermined numerical limitations of the representation symbols.

4. The comprehension enrichment apparatus of claim 3 wherein the blocks are arranged in horizontal arrays with single faces of the blocks revealing representation symbols in the array.

5. The comprehension enrichment apparatus of claim 3 wherein the blocks are arranged in vertical array with representation symbols exposed on opposite sides of the array.

6. The apparatus of claim 3 wherein the blocks are disposed on the base having spaced depressions arranged rectilinearly in square configuration.

7. The apparatus of claim 3 wherein the blocks are arranged so that first and second attachment means are juxtaposed and so that second and second attachment means on different blocks are juxtaposed.

* * * * *